United States Patent [19]

Fitts et al.

[11] Patent Number: 4,528,447

[45] Date of Patent: Jul. 9, 1985

[54] ELECTROSTATIC SHUTTER TUBE HAVING SUBSTANTIALLY ORTHOGONAL PAIRS OF DEFLECTION PLATES

[75] Inventors: Robert W. Fitts, Lititz; Edgar M. Smith, Millersville, both of Pa.

[73] Assignee: RCA Corporation, Princeton, N.J.

[21] Appl. No.: 513,398

[22] Filed: Jul. 14, 1983

[51] Int. Cl.[3] ..... H01J 31/50

[52] U.S. Cl. ..... 250/213 VT; 313/523

[58] Field of Search ..... 313/523, 540, 529, 526, 313/532; 250/213 VT; 315/11

[56] References Cited

U.S. PATENT DOCUMENTS

| | | | |
|---|---|---|---|
| 2,859,377 | 11/1958 | Clemens et al. | 315/10 |
| 2,927,215 | 3/1960 | Allen et al. | 250/217 |
| 2,946,895 | 7/1960 | Stoudenheimer et al. | 250/213 |
| 3,026,412 | 3/1962 | Carlson | 250/71.5 |
| 3,177,390 | 4/1965 | Hickey | 313/99 |
| 3,292,031 | 12/1966 | Hickey | 315/3 |
| 3,355,616 | 11/1967 | Hecker et al. | 313/65 |
| 3,745,404 | 7/1973 | Crost | 315/11 |
| 3,761,614 | 9/1973 | Bradley | 178/7.2 |
| 3,814,979 | 6/1974 | Eberhardt | 315/11 |
| 3,887,841 | 6/1975 | Huston | 315/391 |
| 3,973,117 | 8/1976 | Bradley | 250/199 |
| 4,021,693 | 5/1977 | Bradley et al. | 313/99 |
| 4,120,002 | 10/1978 | Lieber | 358/111 |
| 4,224,511 | 9/1980 | Brjukhnevich et al. | 250/213 VT |

FOREIGN PATENT DOCUMENTS

| | | | |
|---|---|---|---|
| 57-145256 | 8/1982 | Japan | 250/213 VT |

*Primary Examiner*—David C. Nelms
*Assistant Examiner*—J. Jon Brophy
*Attorney, Agent, or Firm*—Eugene M. Whitacre; Dennis H. Irlbeck; Vincent J. Coughlin, Jr.

[57] ABSTRACT

An electrostatic shutter tube comprises a photocathode adapted to emit electrons along a path as an electron image in response to a radiant image incident upon the photocathode. A phosphor screen is spaced from the photocathode and is adapted to emit a light image in response to the impingement of the electron image thereon. A shuttering grid is disposed in the electron path between the photocathode and the phosphor screen to control the emission of the electron image. An anode member adjacent to the screen has therein a pair of primary deflection plates disposed along the electron path for deflecting the electron image in a first direction across the screen. A pair of secondary deflection plates are disposed within the anode member, along the electron path, in a cross-over region of the electron image. The pair of secondary deflection plates are substantially orthogonal to the pair of primary deflection plates and provide deflection of the electron image in a second direction across the screen, which is different from the first direction.

4 Claims, 4 Drawing Figures

ELECTROSTATIC SHUTTER TUBE HAVING SUBSTANTIALLY ORTHOGONAL PAIRS OF DEFLECTION PLATES

BACKGROUND OF THE INVENTION

The invention relates to electrostatic shutter tubes, and particularly to improvements in so-called "light-shutter" image tubes for use in high speed photography wherein substantially orthogonal pairs of deflection plates provide for deflection of an electron image to any of different locations, in two directions or dimensions, on a phosphor screen. The plates are positioned so that the tube length is not increased over tubes having only one pair of deflection plates, and the deflection sensitivity is maximized for both pairs of plates.

U.S. Pat. No. 2,946,895 issued to R. G. Stoudenheimer et al. on July 26, 1960, discloses an image tube of the "light-shutter" type having a single pair of electrostatic deflection plates for directing a focused electron-image to any of different locations, in one dimension, on a phosphor screen. The deflection plates are located in a field-free region within the anode of the tube where they can be closely spaced to provide maximum deflection sensitivity without adversely affecting the focusing field between the apex of the anode and the photocathode. A drawback of the disclosed deflection structure is that the electron image can only be directed in one dimension on the screen.

U.S. Pat. No. 2,859,377 issued to J. E. Clemens et al. on Nov. 4, 1958, discloses an electronic high speed shutter in which two pairs of orthogonally disposed deflection plates are located at the same longitudinal distance from an electron image producing cathode. Since both pairs of plates lie in the same transverse plane, the spacing between the oppositely disposed pairs cannot be as close as the above-described single pair of plates in the Stoudenheimer et al. structure and, therefore, the deflection sensitivity of the Clemens et al. structure is less than that of the Stoudenheimer et al. structure. Additionally, since the pairs of deflection plates are unshielded by an anode, the deflection fields can adversely affect the electrical focusing field. Additional deflection structures showing two pairs of deflection plates located in a transverse plane and spaced an equal longitudinal distance from a cathode are disclosed in U.S. Pat. No. 3,761,614 and in U.S. Pat. No. 3,973,117 issued to D. J. Bradley on Sept. 25, 1973 and on Aug. 3, 1976, respectively. In the Bradley patents, the pairs of deflection plates are located between the anode and the screen so that the deflection fields cannot adversely affect the focusing field; however, the location of the two pairs of plates prevent the close spacing achieved by the single pair of plates in the Stoudenheimer et al. patent and, thus, the deflection sensitivity of the Bradley structures is less than that achieved by the Stoudenheimer structure.

U.S. Pat. No. 4,224,511 issued to Brjuknevich et al. on Sept. 23, 1980, discloses an image intensifier tube having two pairs of deflection plates located at increasing longitudinal distances from an image producing cathode. While such a structure permits a close transverse spacing between the pairs of deflection plates, it increases the length of the tube, thereby increasing the electron image transit time from the cathode to the screen, thus, decreasing the speed of the tube.

SUMMARY OF THE INVENTION

An electrostatic shutter tube comprises source means adapted to emit electrons along a path as an electron image in response to a radiant image incident upon the source means. A phosphor screen spaced from said source means is adapted to emit a light image in response to the impingement of the electron image thereon. Shuttering means disposed in the electron path between the source means and the phosphor screen controls the emission of the electron image. An anode member adjacent to the screen has therein a pair of primary deflection plates disposed along the electron path for deflecting the electron image in a first direction across the screen. The tube is improved by the addition of a pair of secondary deflection plates which are disposed within the anode member, along the electron path, in a cross-over region of the electron image. The secondary deflection plates are substantially orthogonal to the pair of primary deflection plates and provide deflection of the electron image in a second direction across the screen which is different from the first direction.

DETAILED DESCRIPTION OF THE PREFERRED EMBODIMENT

Figure 1:
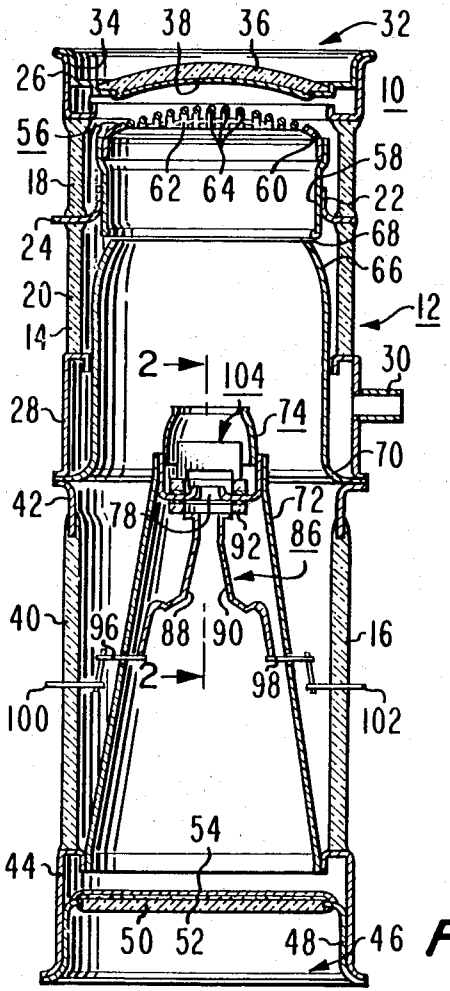
FIG. 1 is a sectional, elevational view of a shutter tube embodying the invention.

As shown in FIG. 1, an electrostatic light-shutter tube 10 includes an envelope 12 which comprises a cathode bulb assembly 14 and an anode bulb assembly 16. The cathode bulb assembly 14 includes a first hollow cylindrical glass portion 18 and a second hollow cylindrical glass portion 20. The glass portions 18 and 20 are of substantially equal diameter and are axially aligned. A shuttering grid support flange 22 is sealed between the adjacent ends of the glass portions 18 and 20. The shutter grid support flange 22 includes an electrical contact tab 24 extending beyond the diameter of the glass portions 18 and 20. A first cathode bulb flange 26 is sealed to the end of the first glass portion 18 opposite the end sealed to the flange 22, and a second cathode bulb flange 28 is sealed to the remote end of the second glass portion 20. A processing tubulation 30, formed of OFHC copper, extends through the second cathode bulb flange 28 and provides a means for introducing materials into the tube and for exhausting occluded gases from within the tube envelope during the processing thereof.

A cathode faceplate assembly 32, comprising a cathode faceplate flange 34 and a glass faceplate 36, closes one end of the cathode bulb assembly 14. The glass faceplate 36, having a substantially spherical curvature, is sealed across the open portion of the faceplate flange 34 transverse to the tube axis. The faceplate flange 34 is welded to the first cathode bulb flange 26. An electron emissive photocathode 38, having a diameter of about 3.5 cm is provided on the inner concave surface of the faceplate 36. The spectral response of the photocathode 38 and of the glass used for the faceplate 36 is tailored to match the input radiation incident thereon. The matching of the faceplate glass and the photocathode to the input radiation is well known in the art and need not be described; however, a general discussion of photocathode materials and glass transmission is contained in the *RCA Photomultiplier Handbook* at pp. 15–19 (2d ed. 1980). The photocathode 38 emits electrons along a path (not shown) in response to a radiant image (also not shown) incident thereon.

The anode bulb assembly 16 includes a third hollow cylindrical glass portion 40 having a diameter substantially equal to that of the glass portions 18 and 20 of the cathode bulb assembly 14. A first anode bulb flange 42 is sealed to one end of the glass portion 40, and a second anode bulb flange 44 is sealed to the other end thereof.

A screen faceplate assembly 46, comprising a screen faceplate flange 48 and a screen faceplate 50, closes one end of the anode bulb assembly 16. The screen faceplate 50 may be a substantially flat glass member or a fiber optic member (not shown) sealed across the open portion of the screen faceplate flange 48. A suitable phosphor screen 52 is formed on the flat inner surface of the faceplate 50. An aluminum film 54 is disposed on the phosphor screen 52 and provides an electrical contact to the faceplate flange 48. The faceplate flange 48 is welded to the second anode bulb flange 44.

Internally, between the photocathode 38 and the phosphor screen 52, the tube 10 includes a plurality of longitudinally spaced electrodes for providing a convergent electrostatic field to focus an electron image along the electron path from the photocathode onto the phosphor screen.

A shuttering grid or G1 electrode 56 is disposed in the electron path in close proximity to the photocathode 38. The G1 electrode 56 comprises a substantially cylindrical metal wall member 58 electrically connected to the shuttering grid support flange 22. The portion of the wall member 58 proximate to the photocathode 38 is slightly flared to accommodate a curved metal plate 60, which is attached thereto and is oriented parallel to the photocathode. The plate 60 is preferably spherical in shape having substantially the same radius of curvature as the cathode faceplate 36. The curved plate 60 has a central aperture 62 having a diameter of the order of the diameter of the photocathode 38. The aperture 62 is crossed by a plurality of equally-spaced fine metal wires 64.

A focusing grid or G2 electrode 66 is positioned with one end 68 close to the G1 electrode 56. The other end of the G2 electrode terminates in a flange portion 70, which is disposed between and fixedly attached, for example, by welding, to the second cathode bulb flange 28 and the first anode bulb flange 42.

Between the G2 electrode 66 and the phosphor screen 52 is an anode electrode 72 which is preferably, but not necessarily, conical in form and includes an anode aperture assembly 74 affixed, for example by welding, to the apex of the anode electrode 72 and positioned just inside the adjacent end of the G2 electrode 66 at approximately the center of curvature of the cathode faceplate 36. The base of the anode electrode 72 is affixed, for example by welding, to the second anode bulb flange 44. The anode aperture assembly 74, shown in detail in FIG. 2, includes a cup-shaped base member 76 having a small central aperture 78 centered on the axis of the tube 10 and defined by a rim portion 80. Affixed to the open end of the base member 76 is a dome-shaped top-cap 82, having a large anode entry aperture 84 centrally disposed therein.

Figure 2:
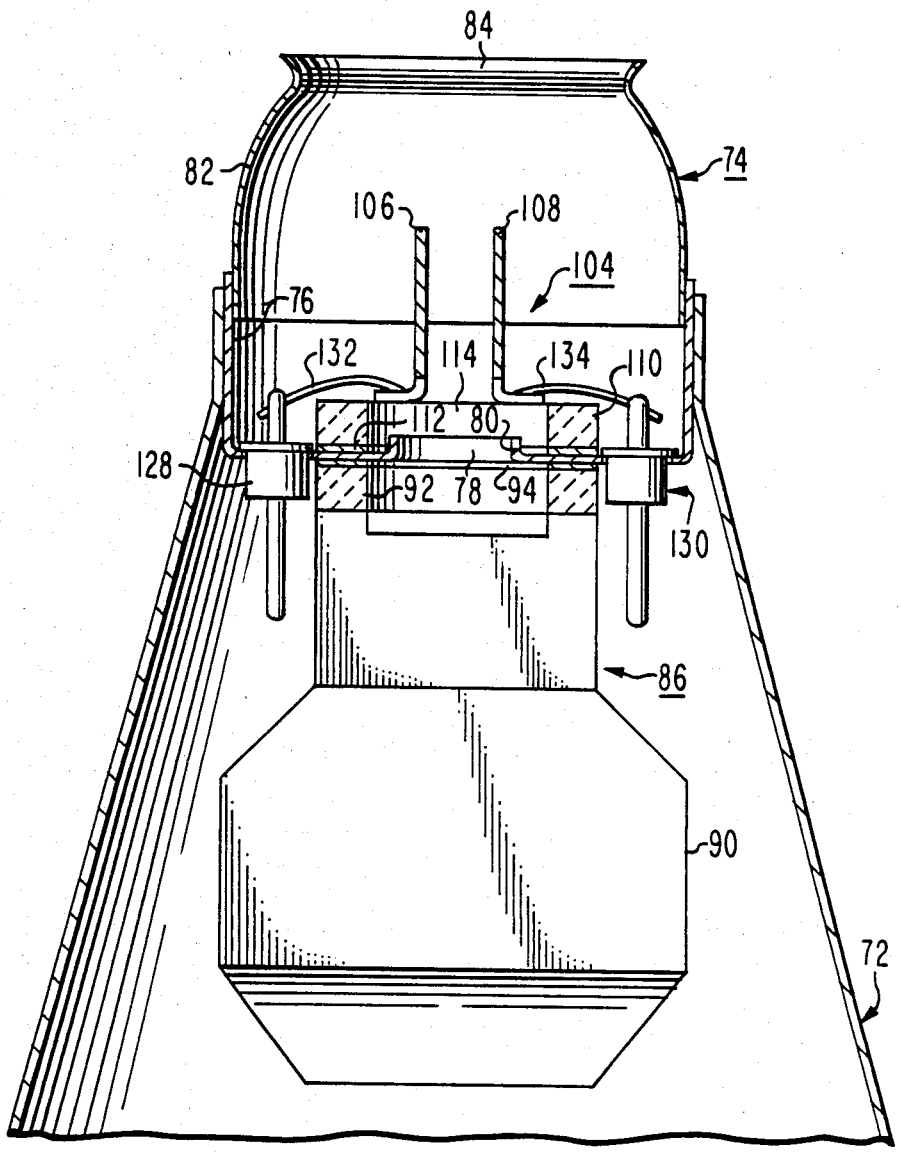
FIG. 2 is an enlarged sectional view of the primary and novel secondary deflection assemblies of the present invention taken along line 2—2 of FIG. 1.

As shown in FIGS. 1 and 2, a primary electrostatic deflection assembly 86 is disposed in the field-free space within the anode electrode 72. The primary deflection assembly 86 includes a pair of primary deflection plates 88 and 90, along the electron path, attached at one end to a primary insulator 92 which, in turn, is attached to a metal primary deflection support plate 94 that is secured to the outer bottom surface of the cup-shaped base member 76. Preferably, the primary insulator 92 comprises a ceramic member, which is brazed between the deflection plates 88 and 90, and the metal support plate 94. As shown in FIG. 1, the primary deflection plates 88 and 90 are closely spaced and centered with respect to the small central aperture 78 to provide maximum deflection sensitivity. Typical spacing between the plates 88 and 90 is of the order of about 0.38 mm. Since the primary deflection plates 88 and 90 are positioned behind the base member 76, which has the small central aperture 78 therethrough, the primary deflection plates cannot adversely affect the electrical focusing field between the anode aperture assembly 74 and the photocathode 38. Suitable leads 96 and 98 extend from the deflection plates 88 and 90, respectively, and pass through and are insulated from the wall of the anode electrode 72. The leads 96 and 98 are connected to electrical terminals 100 and 102 in the wall of the envelope 12. As herein described, the light-shutter tube 10 is conventional and permits deflection of an electron image in only one direction across the phosphor screen.

Figure 3:
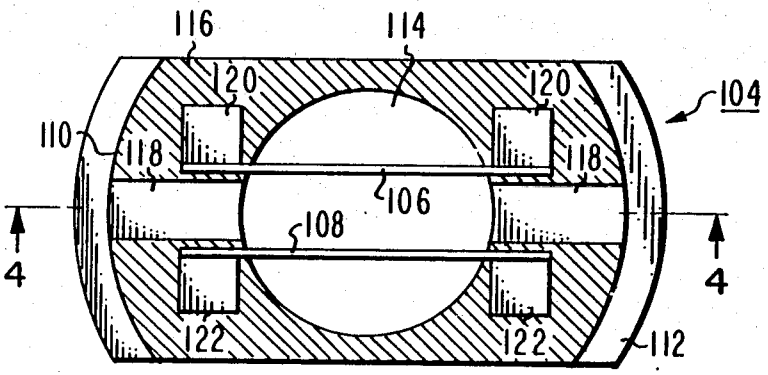
FIG. 3 is a plan view of the novel secondary deflection assembly.
Figure 4:
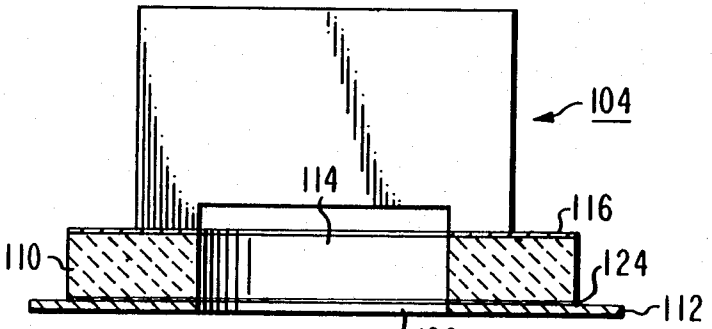
FIG. 4 is a sectional view along the line 4—4 of FIG. 3 showing the novel secondary deflection assembly.

With reference to FIGS. 1–4, a novel secondary deflection assembly 104 comprises a pair of secondary deflection plates 106 and 108, which are disposed along the electron beam path and attached to one surface of a secondary insulator 110, which, in turn, is attached to a secondary metal support plate 112 having a typical thickness of the order of 0.25 mm. Preferably, the secondary insulator 110 comprises a ceramic member having a height of the order of 2.54 mm and including a centrally disposed aperture 114, having a diameter greater than the diameter of the aperture 78 formed in the base member 76. As shown in FIG. 3, one of the major surfaces of the insulator 110 has a metalized pattern 116 disposed thereon. The metalization of ceramics is described in detail in U.S. Pat. No. 3,290,171 issued to J. A. Zollman et al. on Dec. 6, 1966, which is incorporated by reference herein for the purpose of disclosure. The metalized pattern 116 is discontinuous with a gap 118 extending outwardly on opposite sides from the centrally disposed aperture 114 to the periphery of the insulator 110 to permit electrical isolation between the deflection plates 106 and 108. The secondary deflection plates 106 and 108 include support feet 120 and 122, respectively, which are secured to the metalized pattern 116 by a braze material (not shown). As shown in FIG. 4, the opposite major surface of the secondary insulator 110 includes a metalizing layer 124, which is brazed to the secondary support plate 112. The secondary support plate 112 has a central plate aperture 126 formed therethrough that is substantially equal in diameter to the insulator aperture 114. The support plate 112 is dimensioned to extend beyond the periphery of the secondary insulator 110 to facilitate welding the secondary deflection assembly 104 to the inner bottom surface of the cup-shaped base member 76. The secondary deflection plates 106 and 108 of the secondary deflection assembly 104 are oriented substantially orthogonally to the pair of primary deflection plates 88 and 90 to provide deflection of the electron image in a second direction, substantially orthogonal to the first direction, across the phosphor screen 52. Typical spacing between the plates 106 and 108 is of the order of 0.38 mm. The novel secondary deflection assembly 104 is fully contained within the anode aperture assembly 74 so that the secondary deflection plates 106 and 108 are shielded from the focus electrode and the electrical focusing field between the aperture assembly 74 and the photocathode 38. Each of the deflection plates 106 and 108 has an overall height of the order of 9.78 mm and a width of 15.75 mm. A pair of electrical feedthroughs 128 and 130, shown in FIG. 2, are connected by leads 132 and 134 to the deflection plates 106 and 108. Additional leads (not shown) are connected to the feedthroughs 128 and 130 and pass through the anode electrode 72 and through the wall of the envelope 12. The secondary deflection plates 106 and 108 are located substantially at the crossover region of the electron image so that little or no cropping of the electron image occurs. The novel location of the secondary deflection assembly 104, within the existing anode aperture assembly 74 of the anode electrode 72, permits deflection of the electron image in two substantially orthogonal directions with maximum deflection sensitivity and without increasing the length of the tube over the prior art structure described in the above-referenced U.S. Pat. No. 2,946,895.

The operation of the light-shutter tube 20 is described in U.S. Pat. No. 2,946,895 for deflection of an image in one direction. By applying a deflection voltage to the secondary deflection plates 106 and 108 in addition to the deflection voltage applied to the primary deflection plates 88 and 90, the light image emitted by the phosphor screen 52 can be positioned at any of different locations in two dimensions on the phosphor screen.

What is claimed is:

1. In an electrostatic shutter tube comprising source means adapted to emit electrons along a path as an electron image in response to a radiant image incident upon said source means, a phosphor screen spaced from said source means adapted to emit a light image in response to the impingement of said electron image thereon, shuttering means disposed in said electron path between said source means and said phosphor screen to control the emission of said electron image, and an anode member adjacent to said screen having therein a pair of primary deflection plates disposed along said electron path for deflecting said electron image in a first direction across said screen, the improvement wherein a pair of secondary deflection plates being disposed within said anode member along said electron path in a cross-over region of said electron image, said pair of secondary deflection plates being substantially orthogonal to said pair of primary deflection plates to provide deflection of said electron image in a second direction across said screen, said second direction being different from said first direction.

2. In an electrostatic shutter tube comprising a photocathode adapted to emit electrons along a path as an electron image in response to a radiant image incident thereon, a phosphor screen spaced from said photocathode adapted to emit a light image in response to the impingement of said electron image thereon, a focus electrode disposed in said electron path between said photocathode and said screen, a shutter electrode disposed between said focus electrode and said photocathode to control the emission of said electron image, an anode electrode adjacent to said phosphor screen having an anode aperture assembly located in a cross-over region of said electron image, a primary deflection assembly including a pair of primary deflection plates disposed within said anode electrode below said cross-over region for deflecting said electron image in a first direction across said screen, the improvement wherein a secondary deflection assembly including a pair of secondary deflection plates being disposed within said anode aperture assembly substantially at said cross-over region of said electron image and being shielded from said focus electrode by said aperture assembly, said pair of secondary deflection plates being substantially orthogonal to said pair of primary deflection plates to provide deflection of said electron image in a second direction across said screen, said second direction being substantially orthogonal to said first direction.

3. The tube as in claim 2, wherein said secondary deflection assembly further includes a secondary insulator having a centrally disposed aperture therethrough, said secondary deflection plates being attached to one major surface thereof, said secondary insulator being secured to said anode aperture assembly.

4. The tube as in claim 3, wherein said secondary deflection assembly further includes a secondary support plate attached to the opposite major surface of said secondary insulator and secured to said anode aperture assembly.

* * * * *